United States Patent [19]

Ketterer

[11] Patent Number: 4,541,350

[45] Date of Patent: Sep. 17, 1985

[54] THREAD RETAINING CLOTH STRIP FOR LOCKSTITCH SEWING MACHINES

[75] Inventor: Stanley J. Ketterer, Jamesburg, N.J.

[73] Assignee: The Singer Company, Stamford, Conn.

[21] Appl. No.: 667,946

[22] Filed: Nov. 5, 1984

[51] Int. Cl.[4] ..... D05B 47/02; D05B 49/02

[52] U.S. Cl. ..... 112/254; 112/250

[58] Field of Search ..... 139/213, 214; 242/147 R, 149, 150 R, 153; 112/254, 255, 250, 241

[56] References Cited

U.S. PATENT DOCUMENTS

| | | | |
|---|---|---|---|
| 171,558 | 12/1875 | Gibbs . | |
| 276,113 | 4/1883 | Willcox et al. . | |
| 331,026 | 11/1885 | Bigelow . | |
| 864,336 | 8/1907 | Reynolds | 242/149 |
| 908,434 | 11/1908 | Woodward . | |
| 2,179,094 | 11/1939 | Joss | 242/147 R |
| 2,343,659 | 3/1944 | Gerson | 139/213 |
| 3,587,495 | 6/1971 | Johnson . | |
| 4,263,859 | 4/1981 | Johnson . | |
| 4,341,171 | 7/1982 | Johnson . | |
| 4,356,781 | 11/1982 | Rodda . | |
| 4,413,578 | 11/1983 | Rodda . | |
| 4,422,395 | 12/1983 | Rodda . | |

FOREIGN PATENT DOCUMENTS

| | | | |
|---|---|---|---|
| 241302 | 11/1909 | Fed. Rep. of Germany | 139/213 |
| 402545 | 5/1966 | Switzerland | 242/149 |

*Primary Examiner*—Werner H. Schroeder
*Assistant Examiner*—Andrew M. Falik
*Attorney, Agent, or Firm*—William V. Ebs; Robert E. Smith; Edward L. Bell

[57] ABSTRACT

A lockstitch sewing machine is provided with a thread handling device comprising opposing lengths of cloth that receive and frictionally engage thread therebetween to maintain the takeup of the machine thread and impose restraint upon the descent of the thread when the takeup is moved downwardly from a stitch setting position.

5 Claims, 4 Drawing Figures

THREAD RETAINING CLOTH STRIP FOR LOCKSTITCH SEWING MACHINES

BACKGROUND OF THE INVENTION

1. Field of the Invention

The invention is directed to a thread handling arrangement for lockstitch sewing machines.

2. Description of the Prior Art

U.S. Pat. No. 4,263,859 of Ralph E. Johnson for "Thread Handling System for a Sewing Machine", issued Apr. 28, 1981 discloses a thread handling system which includes a thread handling device with elongate members that serve to hold and to meter needle thread to a needle and looptaker of a lockstitch sewing machine. The system further includes a thread tensioner. Thread from a spool extends to the thread tensioner, and beyond the tensioner the thread extends to the thread handling device. Beyond the thread handling device, the thread extends to the needle. A takeup which brackets the thread handling device sets stitches and pulls thread through the tensioner. The takeup moves the thread in one direction in the thread handling device to a stitch setting position at one end of its operating range, and moves in the opposite direction free of thread to the other end of its operating range, after which thread in the device moves to a position of reengagement with the takeup to shorten the path for thread between the tensioner and needle such that a quantity of thread is thereby supplied for use by the needle and looptaker.

It is a prime object of the present invention to provide a thread handling arrangement, of the kind disclosed in the aforementioned patent, with a thread holding and metering device which is both inexpensive and easy to incorporate in a machine.

It is another object of the invention to provide a thread handling device requiring only a single element to retain and meter thread in a thread handling arrangement as described.

Other objects and advantages of the invention will become apparent during a reading of the specification taken in connection with the accompanying drawings.

SUMMARY OF THE INVENTION

A lockstitch sewing machine is provided according to the invention with a thread handling device comprising opposing lengths of cloth that receive and frictionally engage the sewing thread of the machine. Such lengths of cloth maintain the takeup of the machine in a threaded condition, and impose restraint upon descent of the thread resulting in the temporary retention thereof when the takeup is moved downwardly from a stitch setting position.

DESCRIPTION OF THE PREFERRED EMBODIMENT

Figure 1:
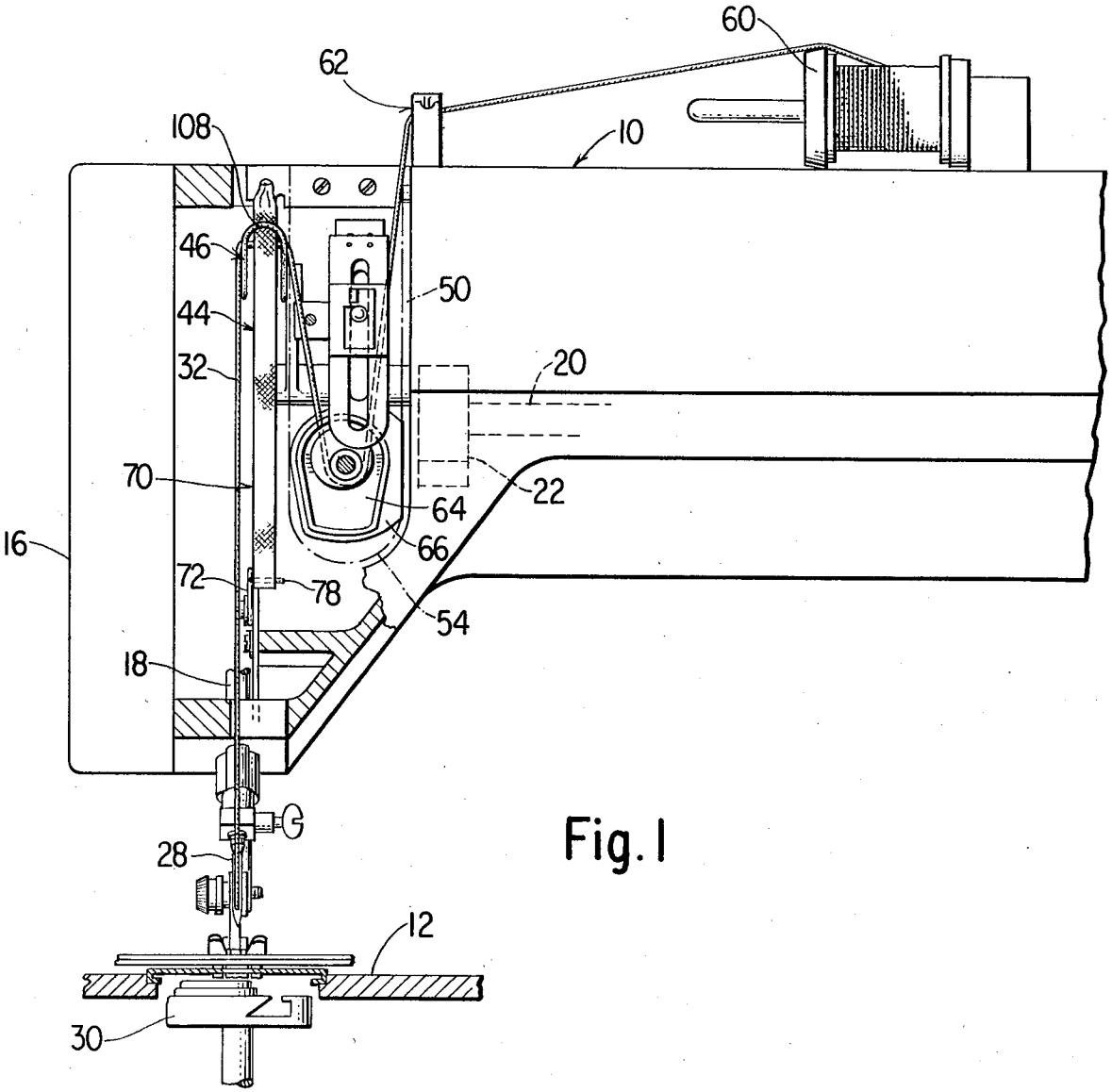
FIG. 1 is a front elevational view of a head end portion of a sewing machine with portions broken away to show the thread handling arrangement of the invention.

Referring to the drawings, reference character 10 designates a portion of a lockstitch sewing maching including a work supporting bed 12 and sewing head 16. A needle bar 18 is carried in the sewing head for endwise reciprocation by a rotating arm shaft 20 acting through a counter-balanced crank 22, a connnecting drive link 24 and finally a collar 26 which is pivotally connected to the needle bar. A sewing needle 28 is carried by the lower end portion of the needle bar 18 and cooperates with a rotary looptaker 30 journalled in the bed and driven in timed relationship to the arm shaft in a well known manner for concatenating needle thread 32 to form lockstitches with bobbin thread (not shown). A detailed description of the manner in which such lockstitches are formed may be found, for example, in U.S. Pat. No. 2,862,208 of R. E. Johnson, for "Ornamental Stitch Sewing Machines", issued Dec. 2, 1958, and assigned to The Singer Company. A presser foot 36, affixed to a presser bar 38 is utilized to urge fabric 37 and 39 into contact with a feed dog 40 by means of which work is advanced under the needle 28. The feed dog is moved in timed relationship to the needle and looptaker by conventional work feeding mechanism which may be of the type shown and described for example, in U.S. Pat. No. 3,527,183, for "Work Feeding Mechanism for Sewing Machines" of The Singer Company, issued Sept. 8, 1972. Thread 32 is supplied to the needle 28 by way of a thread tensioning module 42, a thread handling device 44 according to the invention, and a takeup member 46.

Module 42 and a hollow cover 48 for thread handling device 44 define a self evident threading path in the machine for thread 32 as disclosed in U.S. Pat. No. 4,466,371 of Robert H. Larsen for "Threading Arrangement for a Sewing Machine", issued Aug. 21, 1984. Such self evident threading path includes vertical slots 50 and 52, a curvilinear slot 54 connecting slots 50 and 52, a vertical slot 56, and a horizontally extending across over slot 58 connecting slots 52 and 56. An operator threads the machine by first passing thread 32 from a supply spool 60 through a guide 62, and by then leading the thread downwardly in slot 50, around slot 54, upwardly in slot 52, through cross-over slot 58, downwardly in slot 56, and downwardly from slot 56 to needle 28.

Module 42 is the kind disclosed in U.S. Pat. No. 4,453,480 of Robert H. Larsen and Anthony Giaimo for "Thread Tensioning Module for a Sewing Machine", issued June 12, 1984, and as such includes thread tensioning mechanism with thread engageable parts 64 and 66 for applying tension to thread according to the position of a control knob 68. The module is affixed to the machine on the side of thread handling device 46 in a position with the thread engageable parts disposed relative to the operating range of the takeup member 46 as described in U.S. Pat. No. 4,356,781 of Donald Rodda for "Thread Handling Arrangement for Sewing Machines", issued Nov. 2, 1982. As thread is directed around the module through slots 50, 54 and 52, it is caused to slide into a position between the thread engageable parts 64 and 66.

Thread handling device 44 includes a shoe lace like cloth strip 70, a hold down member 72 for the strip and an angled support 74 therefor. Hold down member 72 is a wire spring having one end portion affixed in the machine under a screw 76. Strip 70 is looped about the other end 78 of the spring to form opposing segments 80 and 82 which extend upwardly therefrom toward the top of the machine. One end of the strip is suitably attached to the top cover 86 of the machine as by a metal tip fastened thereto after the strip has been threaded in place and another metal tip 88 fastened onto the other end of the strip is suitably attached to the inside top surface of hollow cover 48. A gap 90 is thereby provided just under slot 58 between segments 80 and 82 for thread to enter therebetween when the machine is threaded. Angled support 74 is affixed with screws 92 and 93 to top cover 86, and extends therefrom as shown to hold looped strip 70 outwardly from the affixed upper ends. Spring hold down member 72 pulls downwardly on looped strip 70 causing it to be forced against support 74 at a knee 94 on the support, and opposing segments 80 and 82 to engage one another in the region of the knee. Cloth strip 70 is preferably formed with a braided texture since this has been found to best control the downward movement of thread between segments 80 and 82 during the operation of the machine as described hereinafter.

Takeup member 46 and actuating mechanism therefor correspond to like functioning mechanism shown and described in U.S. Pat. No. 4,263,859, mentioned hereinbefore. As shown, the takeup member 46 brackets strip 70 and is affixed to a stub arm 96 extending from one end of a link 98 which has its other end pivotally connected to crank 22. A link 100 pivotally connects at one end to the link 98 as shown and pivotally connects at the opposite end to a fixed member 102. Rotation of the arm shaft 20 results in link 98 being driven by crank 22 and the link 98 guided in its motion by the link 100 imparts reciprocatory updown motion to takeup member 46 along looped strip 70 in timed relationship to the operation of needle 28 and looptaker 30. The takeup member 46 includes thread carrying arms 104 and 106 which extend past the thread entering and thread exiting sides respectively, of looped strip 70 and interconnect at 108 across the front of the strip. The arms 104 and 106 are angled to define thread carrying troughs 109 and 110 between diverging portions.

Figure 2:
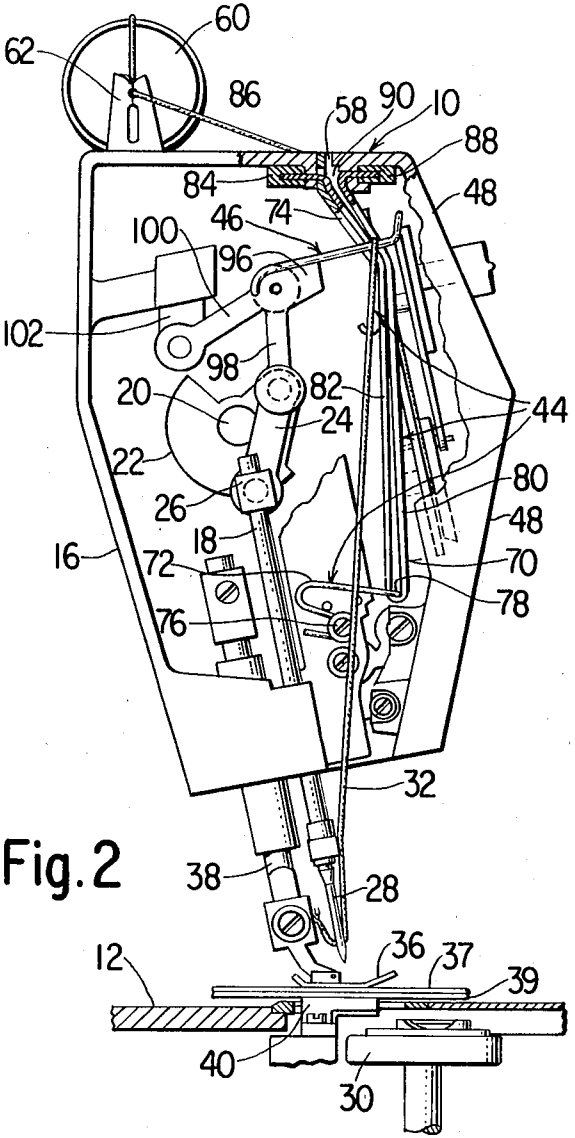
FIG. 2 is a left end elevational view of the head end of the machine with the cover removed.
Figure 3:
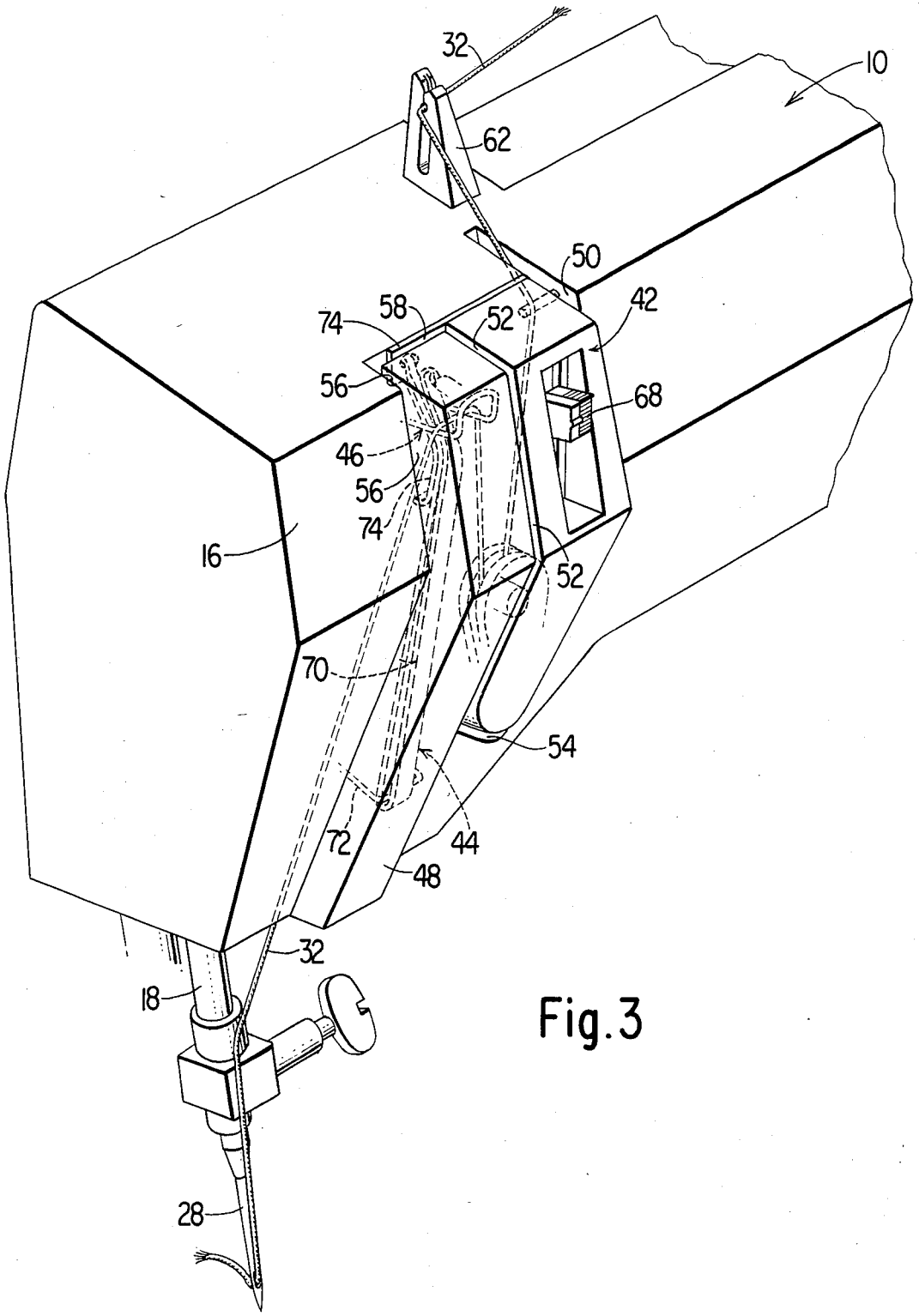
FIG. 3 is a fragmentary perspective view of the sewing machine.
Figure 4:
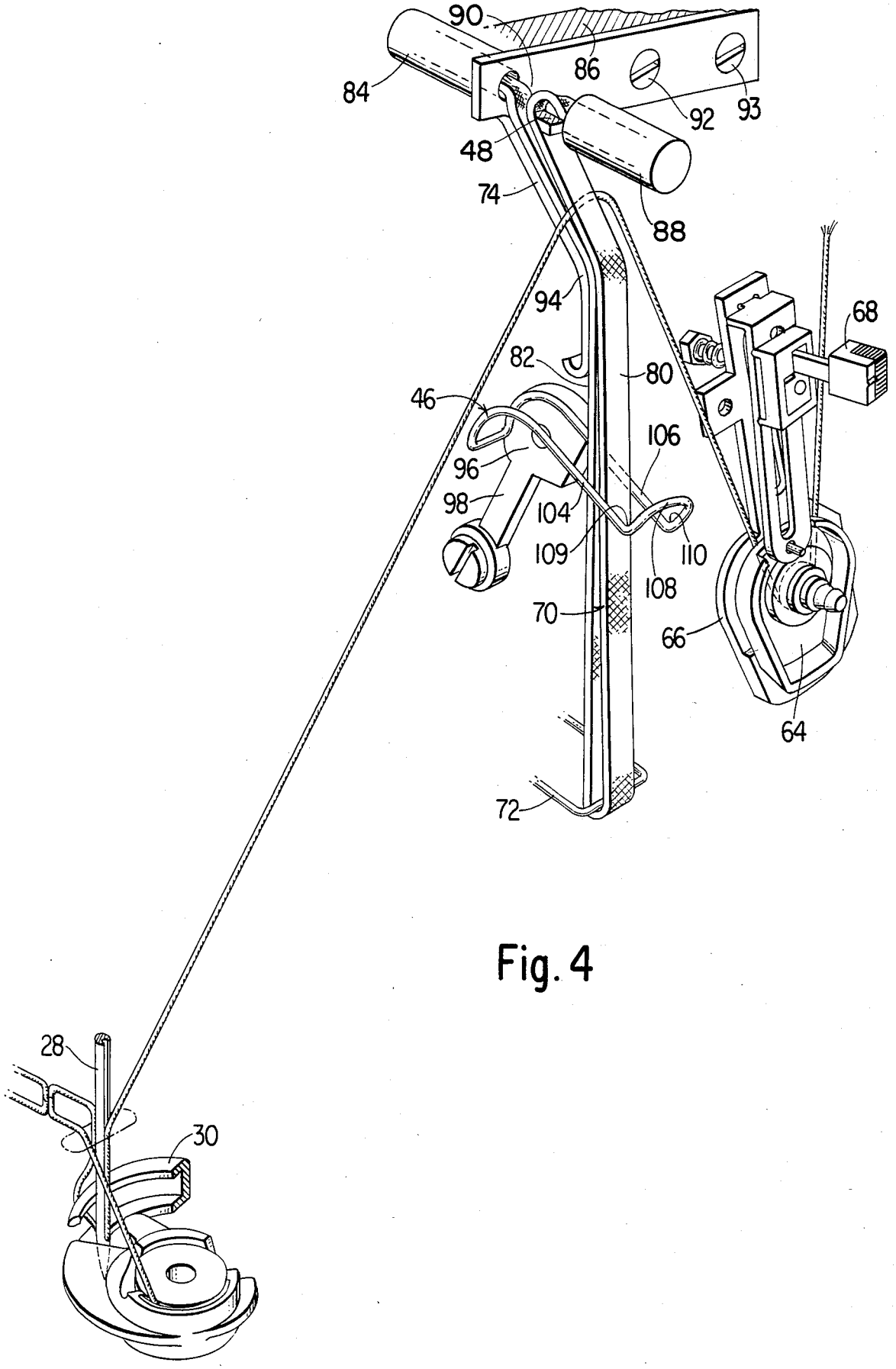
FIG. 4 is a perspective view showing the thread handling arrangement of the invention.

During the operation of the machine, takeup member 46 is moved up and down in timed relation to rotation of the looptaker as described in the said U.S. Pat. No. 4,263,859 of Ralph E. Johnson. The takeup member raises thread 32 between opposing segments 80 and 82 of thread handling device 44 to an uppermost position slightly above the level of knee 94 on support 74 (see FIGS. 1 and 2). When the takeup member starts to move downwardly from the top of its operating range, the thread in the thread handling device is temporarily retained in said uppermost position by frictional engagement of the opposing segments 80 and 82 with the thread (see FIG. 4). However, as the downward movement of the takeup member progresses, the thread is moved downwardly free of member 46 in response to the usual demand for thread by needle 28 and looptaker 30 as described in the U.S. Pat. No. 4,263,859. Frictional engagement of the opposing segments 80 and 82 with thread 32 during the initial portion of its descent in the region of knee 94 causes the thread to be forced into the looptaker beak and past bobbin case hold down means. Thereafter, during downward movement of the thread, frictional engagement of the thread with segment 80 resulting from the angularity of the thread relative to looped strip 70 on the thread entering side thereof provides a measure of control over the thread preventing a sudden descent and unwanted slack.

The descending thread is eventually reengaged by the takeup member and moved upwardly to its temporary retention position in thread handling device 44. As the takeup member moves upwardly, slack thread cast off the looptaker is pulled upwardly by the takeup member to provide for the formation of a stitch in material being sewn. The slack is quickly removed by the takeup member because strip 70 exerts only a light frictional force on the thread, and so avoids excessive thread tension such as would otherwise result in slippage through the thread engaging parts of module 42 and the pulling of thread from spool 60 in advance of stitch setting. The prompt removal of slack is advantageous because thread is thereby removed from the vicinity of the looptaker before it can twist and so prevent proper stitch formation.

It is to be understood that the present disclosure relates to a preferred embodiment of the invention which is for purposes of illustration only and is not to be construed as a limitation of the invention. Numerous alterations and modifications of the structure herein will suggest themselves to those skilled in the art, and all such modifications, and alterations which do not depart from the spirit and scope of the invention are intended to be included within the scope of the appended claims.

I claim:

1. In a sewing machine wherein a sewing needle and looptaker cooperate in the formation of locked stitches in a fabric, the combination comprising: a thread source; thread tensioning means to which thread extends from the thread source; a thread handling device into which the thread extends from the tensioning means and beyond which the thread extends to the needle; and a takeup for setting stitches and pulling thread through the tensioning device from the thread source, the takeup being movable in one direction with thread to a stitch setting position at one end of its operating range whereat the thread is disposed for temporary retention by said device, and movable in the opposite direction free of the thread to the other end of said operating range to permit thread to move in the thread handling device away from the temporary retention position to a position of reengagement with the takeup at said other end of its operating range, and during such movement shorten the path for thread between the tensioning device and needle to supply a quantity of thread for use by the needle and looptaker; said thread handling device including a single elongate cloth strip folded lengthwise upon itself to provide opposing front and rear segments of said single cloth strip that receive and frictionally engage the thread therebetween to impose restraint upon the descent thereof when the takeup is moved in said opposite direction and so provide for said temporary retention of the thread in the device.

2. The combination of claim 1 wherein the cloth has a braided texture.

3. The combination of claim 1 wherein said opposing lengths of cloth are segments of a single cloth strip which is looped about a hold down member and has affixed upper end portions.

4. The combination of claim 3 wherein the hold down member is a spring.

5. The combination of claim 3 including a member which supports the cloth strip to provide for engagement of the opposing segments with one another.

* * * * *